US010610885B1

(12) United States Patent
Kilburn

(10) Patent No.: US 10,610,885 B1
(45) Date of Patent: Apr. 7, 2020

(54) DISPENSING TOOL

(71) Applicant: David Kilburn, Garden Grove, CA (US)

(72) Inventor: David Kilburn, Garden Grove, CA (US)

( * ) Notice: Subject to any disclaimer, the term of this patent is extended or adjusted under 35 U.S.C. 154(b) by 0 days.

(21) Appl. No.: 16/389,127

(22) Filed: Apr. 19, 2019

Related U.S. Application Data

(62) Division of application No. 15/677,356, filed on Aug. 15, 2017, now Pat. No. 10,272,465.

(51) Int. Cl.
*B05C 17/005* (2006.01)
*B05C 17/01* (2006.01)
*B05C 17/015* (2006.01)

(52) U.S. Cl.
CPC .. *B05C 17/00503* (2013.01); *B05C 17/00516* (2013.01); *B05C 17/00596* (2013.01); *B05C 17/015* (2013.01); *B05C 17/0123* (2013.01)

(58) Field of Classification Search
CPC ..... B05C 17/00503; B05C 17/015; B05C 17/00516; B05C 17/00596; B05C 17/0123; B05C 17/0126; B05C 17/012; B05C 17/013
See application file for complete search history.

(56) References Cited

U.S. PATENT DOCUMENTS 2,398,985 A * 4/1946 Welch ..... B05C 17/00516 401/48
3,816,922 A * 6/1974 Thiel ..... B05C 17/00593 433/83
4,932,094 A * 6/1990 McCowin ..... A46B 11/0017 15/29
5,249,716 A 10/1993 O'Sullivan
5,893,486 A * 4/1999 Wasmire ..... B05C 17/00513 222/190
6,234,348 B1 5/2001 Okamura et al.
6,712,238 B1 * 3/2004 Mills ..... E04F 21/08 222/399
7,931,175 B2 4/2011 Hjort
8,333,303 B2 12/2012 Dubach
8,381,674 B2 2/2013 Chang
8,662,779 B2 3/2014 De Virag et al.
8,919,617 B2 12/2014 Foley
9,211,168 B2 12/2015 Broyles et al.
2002/0000450 A1 * 1/2002 Brown ..... B05C 17/003 222/137

FOREIGN PATENT DOCUMENTS

WO WO2006119544 11/2006

* cited by examiner

*Primary Examiner* — J C Jacyna
(74) *Attorney, Agent, or Firm* — Eric Karich; Karich & Associates

(57) ABSTRACT

A dispensing tool for dispensing caulk includes a cartridge housing shaped to receive a cartridge of caulk. The cartridge includes a support bracket which extends to a pivot element, and an applicator head is mounted on the pivot element. A material hose connects the exit nozzle of the cartridge with the applicator head. A dispensing nozzle of the applicator head dispenses the caulk flowing from the cartridge. The cartridge includes a drive mechanism to push the follower of the cartridge to dispense the caulk, and a pneumatic cylinder for moving the applicator head from a first position to a second position, and further includes a return spring for returning the applicator head from the second position to the second position.

3 Claims, 5 Drawing Sheets

DISPENSING TOOL

CROSS-REFERENCE TO RELATED APPLICATIONS

This application for a utility patent is a division of a previously filed utility patent, having the application Ser. No. 15/677,356, filed Aug. 15, 2017.

BACKGROUND OF THE INVENTION

Field of the Invention

This invention relates generally to dispensing tools, and more particularly to a caulk dispensing tool having an adjustable nozzle assembly for adjusting the orientation of an applicator head, and further having a reciprocation system for reciprocating the applicator head as the caulk is being dispensed.

Description of Related Art

Caulk, sealant, adhesive, mastic, and other extrudable, settable materials are typically supplied in sealed, tubular (typically cylindrical) cartridges. The front end of a cartridge is temporarily sealed by a sheet of film or foil behind a leading nozzle. The user can pierce or break the seal immediately before using the contents, thus revealing the fresh and readily extrudable substance for discharge through the nozzle. The rear end of the cartridge is open and houses a follower that rests against the rear of the contents. The follower is pushed against the contents to discharge the contents out the nozzle. When the cartridge is empty, which equates to the follower having advanced to the rear of the nozzle, the cartridge is discarded.

A tool, or more specifically a caulking gun, is used to apply the contents of such a cartridge as desired. A caulking gun typically provides a drop-in holder or receiver for the cartridge. The receiver supports the cartridge in semi-cylindrical, open-topped body that allows the cartridge to be dropped-in, with a front wall having a passage for the cartridge nozzle to extend beyond the front of the tool. The rear end of the receiver is joined to a discharge assistant that includes a pressure plate for engaging the follower. The pressure plate is sized to fit into the cartridge in order to drive forward the follower. Under user control, a grip-type actuator may operate either intermittently or continuously to drive the pressure plate.

The prior art teaches a wide range of dispensing tools for dispensing caulk:

Foley, U.S. Pat. No. 8,919,617, teaches a dispensing tool for dispensing caulk, wherein one end of a caulk cartridge has a discharge nozzle and the opposite end contains a follower that can be pushed toward the nozzle to discharge the contents. A grip-type actuator of the tool advances a pressure plate against the follower to push it toward the nozzle. The tool has a pressure plate aligned with a holder that is sized to retain the cartridge with the follower in line with the pressure plate. A pantograph mechanism drives the pressure plate toward the follower and is driven by a grip-type actuator.

Ilic, W.O. 2006119544, teaches a coupling for interposing between a sealant cartridge outlet and the nozzle supplied by the manufacturer allows articulation so that the sealant can be deposited in confined places. An inlet union is spaced from but connected to an outlet union by a tubular passage. A knob allows the user to nip the unions in any angular disposition by contact with a spacer ring. In a second embodiment, the outlet union includes the nozzle in addition to allowing rotation. In a third embodiment, the passage is replaced by an armoured flexible tube.

Hjort, U.S. Pat. No. 7,931,175, teaches a nozzle for use in connection of dispensing a fluid material. The nozzle includes a first nozzle base, a nozzle tip, and a link connecting the nozzle parts. The link has a first pivotal state and a second locked state when the link is under pressure by the material flow. The link has a first surface and second surface, the surfaces being pivotally connected to each other, and where said surfaces are angled in relation to the longitudinal center axis of the nozzle.

Chang, U.S. Pat. No. 8,381,674, teaches an automated fluid dispenser for smoothly applying a viscous fluid onto a component is provided. The automated fluid dispenser has a nozzle with a nozzle tip and a support. The nozzle can be pivotally attached to the support about a pivot axis. In addition, a tension member can be attached to the nozzle, the tension member applying an anti-pivoting force to the nozzle when it pivots about the pivot axis.

Dubach, U.S. Pat. No. 8,333,303, teaches a metering device particularly for adhesives and sealants, that can be placed on a flexible container by means of an adapted ring, a lever being connected to the ring, and pressing against the container. A push button is formed onto the lever as an extension.

De Virag, U.S. Pat. No. 8,662,779, teaches a dispenser for dispensing food products (fluid, gelatin, etc.). Disposable cartridges containing fluid material can be attached to the dispenser, and the material within can be dispensed on a surface. The dispenser provides metered dispensing, and a variety of tips, some angled.

The prior art teaches various forms of caulk dispensing tools. However, the prior art does not teach dispensing tool that includes an adjustable nozzle assembly that may be adjusted so that an applicator head of the adjustable nozzle assembly is adjusted to different angles and positions. The prior art also does not teach a dispensing tool that includes a reciprocation system to reciprocate the applicator head while the caulk is being dispensed. The present invention fulfills these needs and provides further advantages as described in the following summary.

SUMMARY OF THE INVENTION

The present invention teaches certain benefits in construction and use which give rise to the objectives described below.

The present invention provides a dispensing tool for dispensing caulk. The dispensing tool includes a cartridge housing shaped to receive a cartridge of caulk. The cartridge includes a support bracket which extends to a pivot element, and an applicator head is mounted on the pivot element. A material hose connects an exit nozzle of the cartridge with the applicator head. A dispensing nozzle of the applicator head dispenses the caulk flowing from the cartridge. The cartridge includes a drive mechanism to push the follower of the cartridge to dispense the caulk, and a reciprocation system reciprocates the applicator head as the caulk is being dispensed through the dispensing nozzle. In one embodiment, the reciprocation system includes a pneumatic cylinder operably connected with the pneumatic system for moving the applicator head from a first position to a second position, and further includes a return spring for returning the applicator head from the second position to the second position.

A primary objective of the present invention is to provide a dispensing tool having advantages not taught by the prior art.

Another objective is to provide a dispensing tool that includes an adjustable nozzle assembly that may be adjusted so that an applicator head of the adjustable nozzle assembly is adjusted to different angles and position.

A further objective is to provide a dispensing tool that includes a reciprocation system to reciprocate the applicator head while the caulk is being dispensed.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a dispensing tool 10 for dispensing caulk 14 from a cartridge 12.

Figure 1:
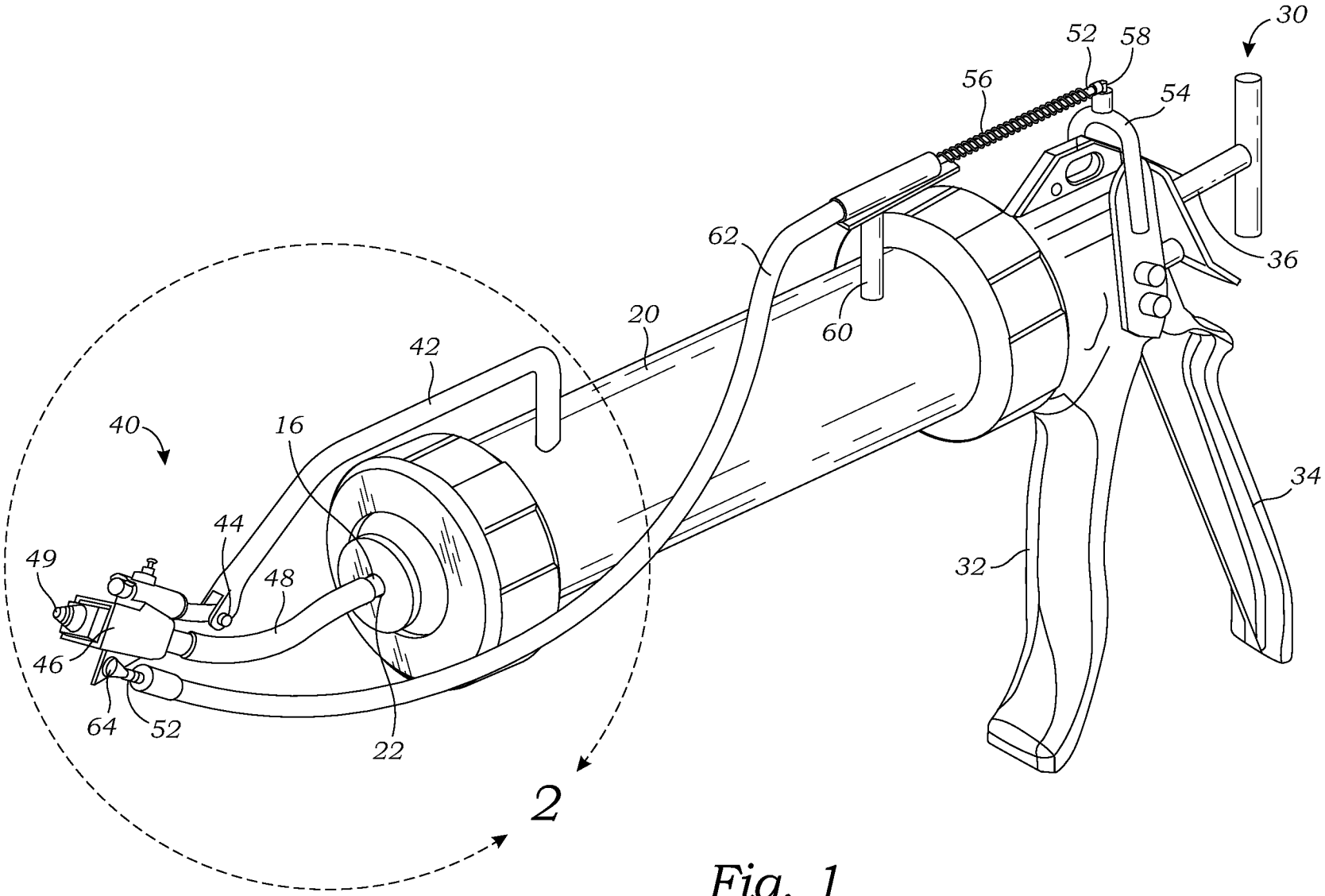
FIG. 1 is a perspective view of a dispensing tool according to one embodiment of the present invention.

FIG. 1 is a perspective view of a dispensing tool 10 according to one embodiment of the present invention. As shown in FIG. 1, the dispensing tool 10 includes a cartridge housing 20 shaped to receive the cartridge 12 of the caulk 14 (shown in FIG. 4, and discussed in greater detail below). The cartridge housing 20 includes an exit port 22 through which an exit nozzle 16 of the cartridge 12, shown in FIG. 4, extends when the cartridge 12 is positioned within the cartridge housing 20. As shown in FIG. 1, the cartridge housing 20 is generally similar to prior art devices; however, the dispensing tool 10 of the present invention further includes an adjustable nozzle assembly 40 that may be adjusted so that an applicator head 46 of the adjustable nozzle assembly 40 is adjusted to different angles and position. The adjustable nozzle assembly 40 is shown in greater detail in F 2, and is discussed in greater detail below.

As shown in FIG. 1, the dispensing tool 10 includes a drive mechanism 30 to push the follower of the cartridge 12 to dispense the caulk 14. In the embodiment of FIG. 1, the drive mechanism 30 includes a handle 32 and a pull lever 34 that, when squeezed together advance a push rod 36 against the follower plate 18. Since the general construction of this embodiment is known in the art, it is not described in greater detail herein. In alternative embodiments, the drive mechanism 30 may include alternative constructions, such as the pneumatic system 106 described below, as well as alternative constructions known in the art, or which may be readily devised by one skilled in the art, consistent with the teachings of the present invention, and such alternatives should be considered within the scope of the present invention.

Figure 2:
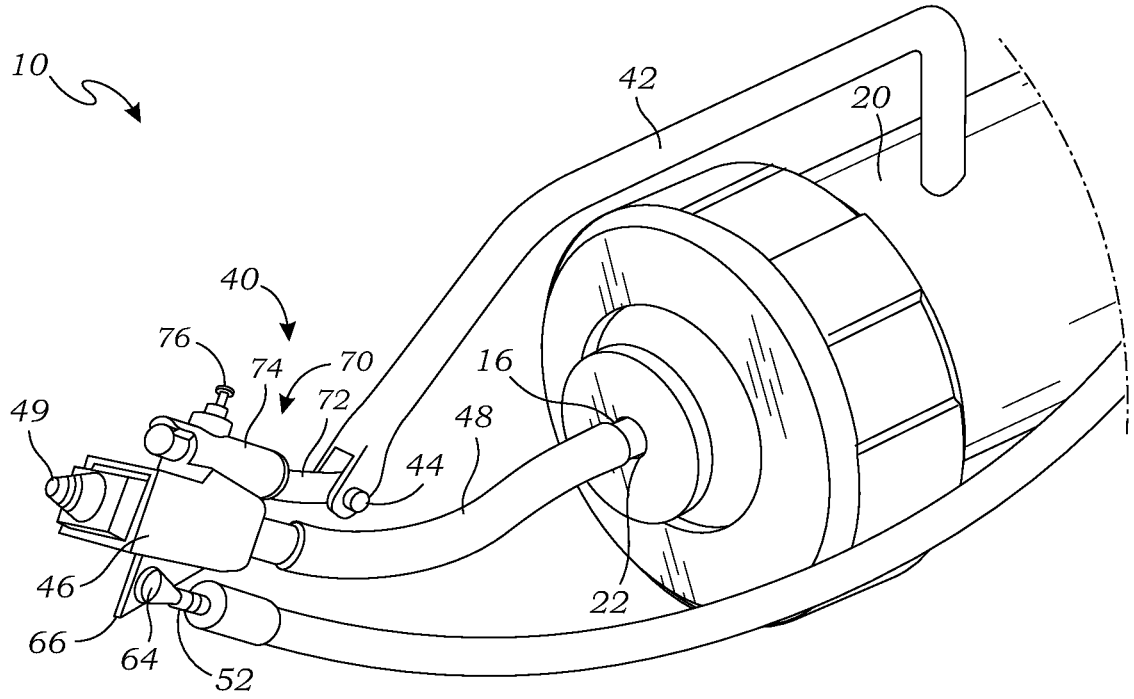
FIG. 2 is a close up view of an adjustable nozzle assembly of the dispensing tool, taken along 2-2 in FIG. 1.

FIG. 2 is a close up view of the adjustable nozzle assembly 40 of the dispensing tool 10, taken along 2-2 in FIG. 1. As shown in FIG. 2, the adjustable nozzle assembly 40 may include a support bracket 42 extending from the cartridge housing 20 to a pivot element 44. While one embodiment of the support bracket 42 is illustrated, any similar or equivalent form of support structure may be used to support the pivot element 44, and any alternative structures devised by one skilled in the art should be considered within the scope of the present invention.

As shown in FIGS. 1-2, an applicator head 46 is mounted on the pivot element 44 so that the applicator head 46 can pivot on the pivot element 44. The applicator head 46 is "mounted on" the pivot element 44 if it is either directly connected, or connected through other components, as discussed below, so that it may pivot as shown and described, and alternative methods of mounting may also be utilized.

A material hose 48 connects the exit nozzle 16 of the cartridge 12 with the applicator head 46. The material hose 48 is flexible enough to enable the pivoting described herein, but may otherwise be constructed of any form of suitable material for transmitting the caulking materials. The applicator head 46 includes a dispensing nozzle 49 that is adapted to dispense the caulk 14 flowing from the cartridge 12 (shown in FIG. 4), through the material hose 48, and out through the applicator head 46.

Figure 3:
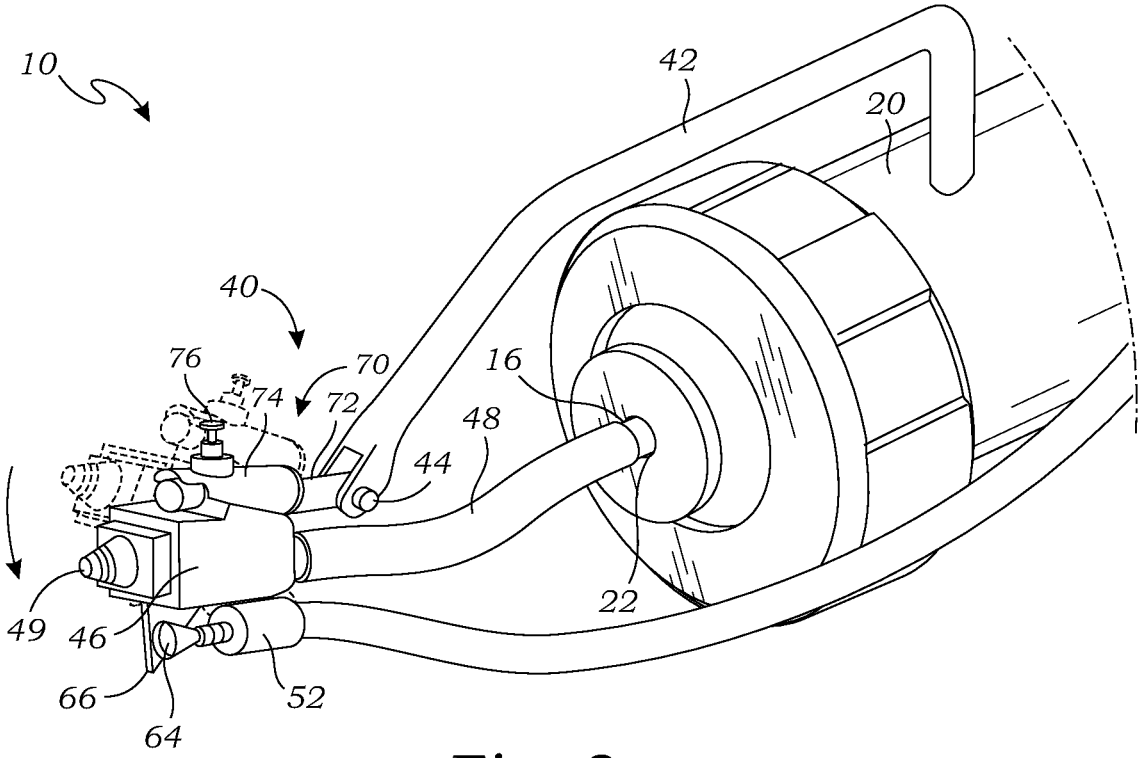
FIG. 3 is a close up view of the adjustable nozzle assembly of FIG. 2, illustrating movement of an applicator head from a first position to a second position.

FIG. 3 is a close up view of the adjustable nozzle assembly 40 of FIG. 2, illustrating movement of an applicator head 46 from a first position to a second position. As shown in FIG. 3, the dispensing nozzle 49 of the applicator head 46 may therefore be pivotally adjusted on the pivot element 44 to adjust the dispensing of the caulk.

As show in FIGS. 1-3, the dispensing tool 10 further includes a reciprocation system 50 to reciprocate the applicator head 46 while the caulk 14 is being dispensed. In the embodiment of FIG. 1, the reciprocation system 50 includes an actuator cable 52 that operably connects a pull lever 34 with the applicator head 46, so that movement of the pull lever 34 causes movement of the applicator head 46. In this embodiment, the pull lever 34 is operably connected with the actuator cable 52 through an actuation lever 54 that is operably connected with the pull lever 34. In this arrangement, the actuator cable 52 and the applicator head 46 all move together from a first position to a second position, as shown in FIG. 3, when the pull lever 34 is squeezed towards the handle 32. The return spring 56 functions to return the pull lever 34, the actuator cable 52, and the applicator head 46, back to the first position.

In the embodiment of FIGS. 1-3, the actuator cable 52 of the reciprocation system 50 is attached to the actuation lever 54 of the pull lever 34 via a cable bolt 58. In this embodiment, the reciprocation system 50 further comprises a cable mount 60 that is fixedly mounted on the cartridge housing 20 and extends to a mounting tube 62 through which the actuator cable 52 extends. In this embodiment, the return spring 56 is positioned between the mounting tube 62 of the cable mount 60, and the cable bolt 58.

In this embodiment, as best shown in FIG. 2, the actuator cable 52 is attached to the applicator head 46 via a cable pivot attachment 64 which may be attached to the applicator head 46 via flange 66. Obviously, those skilled in the art may devise alternative structures for this purpose, and such alternatives should be considered within the scope of the present invention.

Also as shown in FIG. 2, the applicator head 46 may be connected with the pivot element 44 via a hinge 70, which in this case includes a rod 72 which engages a receiver 74 (e.g., tubular) which enables the applicator head 46 to twist with respect to rod 72. A spring plunger 76 may be included to removably engage the rod 72 with the receiver 74, for locking the position of the hinge 70 once it has been adjusted to a desired position. The terms "rod" and "receiver" are hereby defined to include the inverse construction, and any other equivalent forms of hinge structure known in the art.

While one particular embodiment of the reciprocation system 50 is illustrated herein, and a second pneumatic embodiment is also discussed below, those skilled in the art may devise many alternative constructions that perform in a similar or equivalent manner, and such alternatives should be considered within the scope of the present invention.

Figure 4:
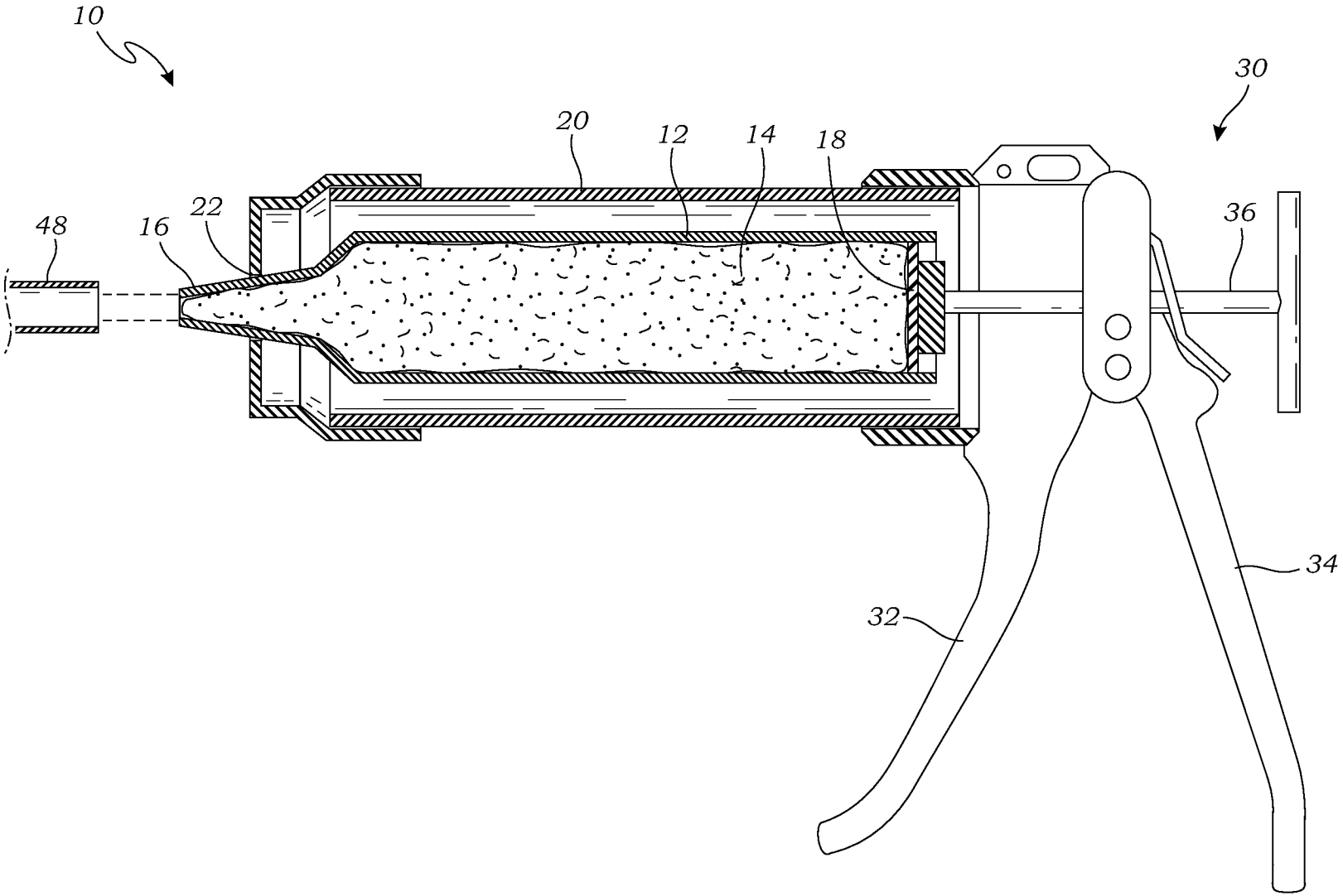
FIG. 4 is a cross sectional view of the dispensing tool of FIG. 1, taken from the side of the dispensing tool.

FIG. 4 is a cross sectional view of the dispensing tool 10 of FIG. 1, taken from the side of the dispensing tool 10. As shown in FIG. 4, the dispensing tool 10 is used to dispense caulk 14 from a cartridge 12 having a follower to dispense the caulk 14 through an exit nozzle 16 of the cartridge 12. Since this general construction is known in the art, it is not discussed in greater detail herein. For purposes of this application, the term "caulk 14" is hereby defined to include any form of caulk 14 sealant, adhesive, mastic, and other extrudable, settable materials of a similar nature.

Figures 5, 6:
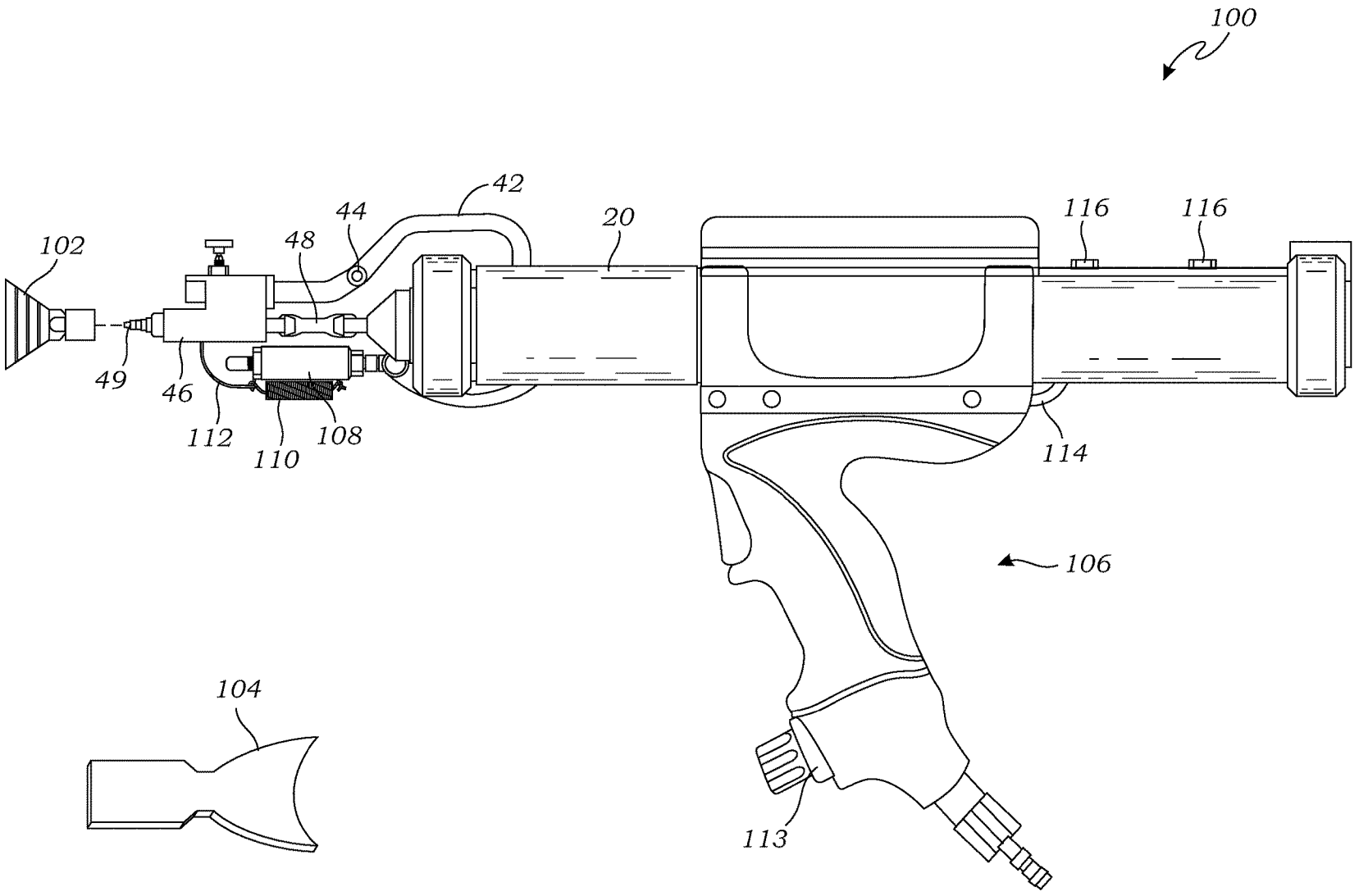
FIG. 5 is an exploded side elevational view of a second embodiment of the dispensing tool, further illustrating a dispensing tip.
FIG. 6 is a side elevational view of a second embodiment of the dispensing tip.

FIG. 5 is an exploded side elevational view of a second embodiment of the dispensing tool 100, further illustrating a disposable dispensing tip 102. As shown in FIG. 5, in this embodiment the drive mechanism 30 includes a pneumatic system 106 for driving the follower plate 18. In this embodiment, the reciprocation system 50 includes a pneumatic cylinder 108 operably connected with the pneumatic system 106 for moving the applicator head 46 from a first position to a second position, as discussed above, and further includes a return spring 110 for returning the applicator head 46 from the second position to the second position.

As shown in FIG. 5, the pneumatic cylinder 108 and the return spring 110 are attached to the applicator head with a connector 112, in this case a cable or equivalent for of wire, string, or other form of connector known in the art. The dispensing tool 100 includes a pulse valve/regulator 113, pneumatic hoses 114, and pneumatic valves 116 for regulating the pneumatic pressure and for operably moving the pneumatic cylinder 108 for reciprocating the applicator head, as discussed above. In an alternative embodiment, the pulse valve/regulator 113 may be an electronic or pneumatic pulse valve/regulator.

The disposable dispensing tip 102 is shaped to engage the dispensing nozzle 49 so that the caulk 14 flowing from the dispensing nozzle 49 flows through the disposable dispensing tip 102.

FIG. 6 is a side elevational view of a second embodiment of the disposable dispensing tip 104. As shown in FIGS. 5 and 6, the disposable dispensing tip 1024 may have a variety of shapes and sizes, to enable the user to adjust the manner in which the caulk 14 is dispensed.

Figure 7:
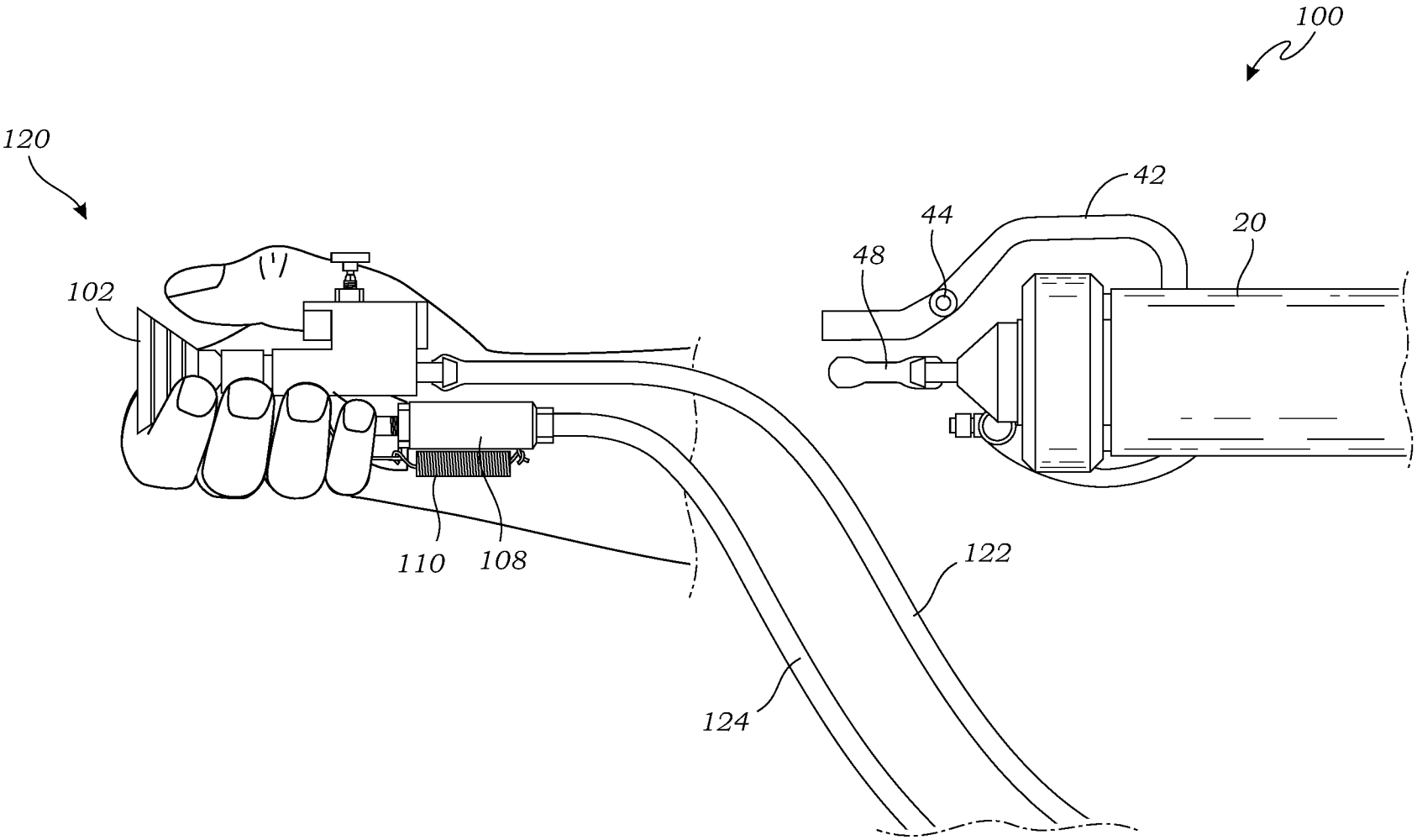
FIG. 7 is a side elevational view of a second embodiment of the adjustable nozzle assembly of the dispensing tool of FIG. 5, illustrating the adjustable nozzle assembly detached from the dispensing tool for manual manipulation of the adjustable nozzle assembly.

FIG. 7 is a side elevational view of a third embodiment of the adjustable nozzle assembly 120 of the dispensing tool of FIG. 5, illustrating the adjustable nozzle assembly 120 detached from the dispensing tool for manual manipulation of the adjustable nozzle assembly 120. In this embodiment, the adjustable nozzle assembly 120 is attached with tubes 122 and 124, which are longer (e.g., 2 feet), allowing for manual manipulation of the adjustable nozzle assembly 120 for work in tight spaces.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by the following claims.

What is claimed is:

1. A dispensing tool for dispensing caulk from a cartridge having a follower to dispense the caulk through an exit nozzle of the cartridge, the dispensing tool comprising:

a cartridge housing shaped to receive the cartridge of the caulk;

a support bracket extending from the cartridge housing to a pivot element;

an applicator head mounted on the pivot element so that the applicator head can pivot on the pivot element;

a material hose that is connected to the exit nozzle of the cartridge and is adapted to connect to the applicator head;

a dispensing nozzle of the applicator head dispenses the caulk flowing from the cartridge;

a drive mechanism that is adapted to push the follower of the cartridge to dispense the caulk; and a reciprocation system for reciprocating the applicator head as the caulk is being dispensed through the dispensing nozzle.

2. The dispensing tool of claim 1, wherein the drive mechanism includes a pneumatic system for driving the follower; and wherein the reciprocation system includes a pneumatic cylinder operably connected with the pneumatic system for moving the applicator head from a first position to a second position, and further includes a return spring for returning the applicator head from the second position to the second position.

3. A dispensing tool for dispensing caulk from a cartridge having a follower to dispense the caulk through an exit nozzle of the cartridge, the dispensing tool comprising:

a cartridge housing shaped to receive the cartridge of the caulk;

a support bracket extending from the cartridge housing to a pivot element;

an applicator head mounted on the pivot element so that the applicator head can pivot on the pivot element;

a material hose that is connected to the exit nozzle of the cartridge and is adapted to connect to the applicator head;

a dispensing tip operably mounted on the applicator head such that the caulk flowing from the exit nozzle of the cartridge, then passes through the material hose and the applicator head, is dispensed out through the dispensing tip of the applicator head;

a drive mechanism that is adapted to push the follower of the cartridge to dispense the caulk, the drive mechanism including a pneumatic system that is adapted for driving the follower;

a reciprocation system for reciprocating the applicator head as the caulk is being dispensed through the dispensing tip; and wherein the reciprocation system includes a pneumatic cylinder operably connected with the pneumatic system for moving the applicator head from a first position to a second position, and further includes a return spring for returning the applicator head from the second position to the first position.

* * * * *